US006341441B1

(12) United States Patent
Morales

(10) Patent No.: US 6,341,441 B1
(45) Date of Patent: Jan. 29, 2002

(54) ILLUMINATED ADDRESS SIGN

(76) Inventor: Eduardo Morales, 401 E. Tubbs, Bishop, TX (US) 78343

( * ) Notice: Subject to any disclaimer, the term of this patent is extended or adjusted under 35 U.S.C. 154(b) by 0 days.

(21) Appl. No.: 09/473,092

(22) Filed: Dec. 28, 1999

(51) Int. Cl.[7] ..... G09F 13/04

(52) U.S. Cl. ..... 40/564; 40/568; 362/812; 362/367; 362/253

(58) Field of Search ..... 362/812, 351, 362/311, 367, 253; 90/564, 574, 568, 570, 562, 573, 541; 40/559

(56) References Cited

U.S. PATENT DOCUMENTS

| | | | | | |
|---|---|---|---|---|---|
| 3,348,221 | A | * | 10/1967 | Duffield | 362/253 |
| 3,931,689 | A | * | 1/1976 | Shine | 40/132 R |
| 3,986,019 | A | * | 10/1976 | de Vos et al. | 240/147 |
| 4,138,716 | A | * | 2/1979 | Muhlethaler et al. | 362/375 |
| 4,158,222 | A | * | 6/1979 | Cook | 362/269 |
| 4,272,901 | A | | 6/1981 | Matthews | |
| 4,373,284 | A | | 2/1983 | Crane | |
| 4,398,239 | A | * | 8/1983 | de Vos et al. | 362/263 |
| 4,611,265 | A | | 9/1986 | Davis | |
| 4,667,978 | A | * | 5/1987 | Poyer | 362/267 |
| 4,951,406 | A | | 8/1990 | Lemire | |
| 5,048,210 | A | * | 9/1991 | Taylor et al. | 40/575 |
| 5,263,271 | A | * | 11/1993 | Cox et al. | 40/564 |
| D377,809 | S | | 2/1997 | Di Marco, Sr. et al. | |
| 5,729,924 | A | | 3/1998 | Reading | |
| 5,768,814 | A | * | 6/1998 | Kozek et al. | 40/570 |
| 5,826,973 | A | * | 10/1998 | Melzian et al. | 362/297 |
| 5,832,642 | A | * | 11/1998 | Dalton | 40/546 |
| 5,890,306 | A | * | 4/1999 | Smith | 40/576 |
| 5,950,340 | A | * | 9/1999 | Woo | 40/564 |
| 5,980,062 | A | * | 11/1999 | Bell | 362/184 |
| 6,057,778 | A | * | 5/2000 | Davidson | 340/693.5 |

* cited by examiner

*Primary Examiner*—Lynne H. Browne
*Assistant Examiner*—Kenn Thompson

(57) ABSTRACT

A illuminated address sign for hanging an illuminated sign on either a vertical or horizontal surface. The illuminated address sign includes an apparatus for holding a light bulb and signage on a structure. The apparatus contains a base for mounting on a wall of the structure. The base has base wall, a plate defining a top wall, and two pair of opposing side walls. A plurality of bores is in the base wall. A plurality of bores in the top plate holds the light socket. A light socket holds the light bulb. The light socket is mounted in one of the bores of the plate. A wire connects the light socket to a power source. The wire enters the base through one of the bores in the base wall. The wire is operationally coupled to the light socket. A switch actuates the light bulb. A plurality of fasteners fastens the base to the structure. Each of the fasteners is placed through one of the bores in the base wall. A covering for placing over the base has a first portion and a second portion. The first portion has a shape adapted to fit over the base. The second portion forms a hollow enclosure. The covering is formed from translucent material.

9 Claims, 4 Drawing Sheets

ILLUMINATED ADDRESS SIGN

BACKGROUND OF THE INVENTION

1. Field of the Invention

The present invention relates to illuminated signs and more particularly pertains to a new illuminated address sign for hanging an illuminated sign on either a vertical or horizontal surface.

2. Description of the Prior Art

The use of illuminated signs is known in the prior art. More specifically, illuminated signs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,611,265; U.S. Pat. No. 4,272,901; U.S. Pat. No. 5,729,924; U.S. Pat. No. 4,951,406; U.S. Pat. No. 4,373,284; and U.S. Des. Pat. No. 377,809.

While these devices fulfill their respective, particular objectives and requirements, the aforementioned patents do not disclose a new illuminated address sign. The inventive device includes an apparatus for holding a light bulb and signage on a structure. The apparatus contains a base for mounting on a wall of the structure. The base has base wall, a plate defining a top wall, and two pair of opposing side walls. A plurality of bores is in the base wall. A plurality of bores in the top plate holds the light socket. A light socket holds the light bulb. The light socket is mounted in one of the bores of the plate. A wire connects the light socket to a power source. The wire enters the base through one of the bores in the base wall. The wire is operationally coupled to the light socket. A switch actuates the light bulb. A plurality of fasteners fastens the base to the structure. Each of the fasteners is placed through one of the bores in the base wall. A covering for placing over the base has a first portion and a second portion. The first portion has a shape adapted to fit over the base. The second portion forms a hollow enclosure. The covering is formed from translucent material.

In these respects, the illuminated address sign according to the present invention substantially departs from the conventional concepts and designs of the prior art, and in so doing provides an apparatus primarily developed for the purpose of hanging an illuminated sign on either a vertical or horizontal surface.

SUMMARY OF THE INVENTION

In view of the foregoing disadvantages inherent in the known types of illuminated signs now present in the prior art, the present invention provides a new illuminated address sign construction wherein the same can be utilized for hanging an illuminated sign on either a vertical or horizontal surface.

The general purpose of the present invention, which will be described subsequently in greater detail, is to provide a new illuminated address sign apparatus and method which has many of the advantages of the illuminated signs mentioned heretofore and many novel features that result in a new illuminated address sign which is not anticipated, rendered obvious, suggested, or even implied by any of the prior art illuminated signs, either alone or in any combination thereof.

To attain this, the present invention generally comprises an apparatus for holding a light bulb and signage on a structure. The apparatus contains a base for mounting on a wall of the structure. The base has base wall, a plate defining a top wall, and two pair of opposing side walls. A plurality of bores is in the base wall. A plurality of bores in the top plate holds the light socket. A light socket holds the light bulb. The light socket is mounted in one of the bores of the plate. A wire connects the light socket to a power source. The wire enters the base through one of the bores in the base wall. The wire is operationally coupled to the light socket. A switch actuates the light bulb. A plurality of fasteners fastens the base to the structure. Each of the fasteners is placed through one of the bores in the base wall. A covering for placing over the base has a first portion and a second portion. The first portion has a shape adapted to fit over the base. The second portion forms a hollow enclosure. The covering is formed from translucent material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated address sign apparatus and method which has many of the advantages of the illuminated signs mentioned heretofore and many novel features that result in a new illuminated address sign which is not anticipated, rendered obvious, suggested, or even implied by any of the prior art illuminated signs, either alone or in any combination thereof.

It is another object of the present invention to provide a new illuminated address sign which may be easily and efficiently manufactured and marketed.

It is a further object of the present invention to provide a new illuminated address sign which is of a durable and reliable construction.

An even further object of the present invention is to provide a new illuminated address sign which is susceptible of a low cost of manufacture with regard to both materials and labor, and which accordingly is then susceptible of low prices of sale to the consuming public, thereby making such illuminated address sign economically available to the buying public.

Still yet another object of the present invention is to provide a new illuminated address sign which provides in the apparatuses and methods of the prior art some of the advantages thereof, while simultaneously overcoming some of the disadvantages normally associated therewith.

Still another object of the present invention is to provide a new illuminated address sign for hanging an illuminated sign on either a vertical or horizontal surface.

Yet another object of the present invention is to provide a new illuminated address sign which includes an apparatus for holding a light bulb and signage on a structure. The apparatus contains a base for mounting on a wall of the structure. The base has base wall, a plate defining a top wall, and two pair of opposing side walls. A plurality of bores is in the base wall. A plurality of bores in the top plate holds the light socket. A light socket holds the light bulb. The light socket is mounted in one of the bores of the plate. A wire connects the light socket to a power source. The wire enters the base through one of the bores in the base wall. The wire is operationally coupled to the light socket. A switch actuates the light bulb. A plurality of fasteners fastens the base to the structure. Each of the fasteners is placed through one of the bores in the base wall. A covering for placing over the base has a first portion and a second portion. The first portion has a shape adapted to fit over the base. The second portion forms a hollow enclosure. The covering is formed from translucent material.

Still yet another object of the present invention is to provide a new illuminated address sign that can be powered by conventional wiring from a dwelling or from a battery power source.

Even still another object of the present invention is to provide a new illuminated address sign that has number indicia that can be oriented consistently with the covering of the sign.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
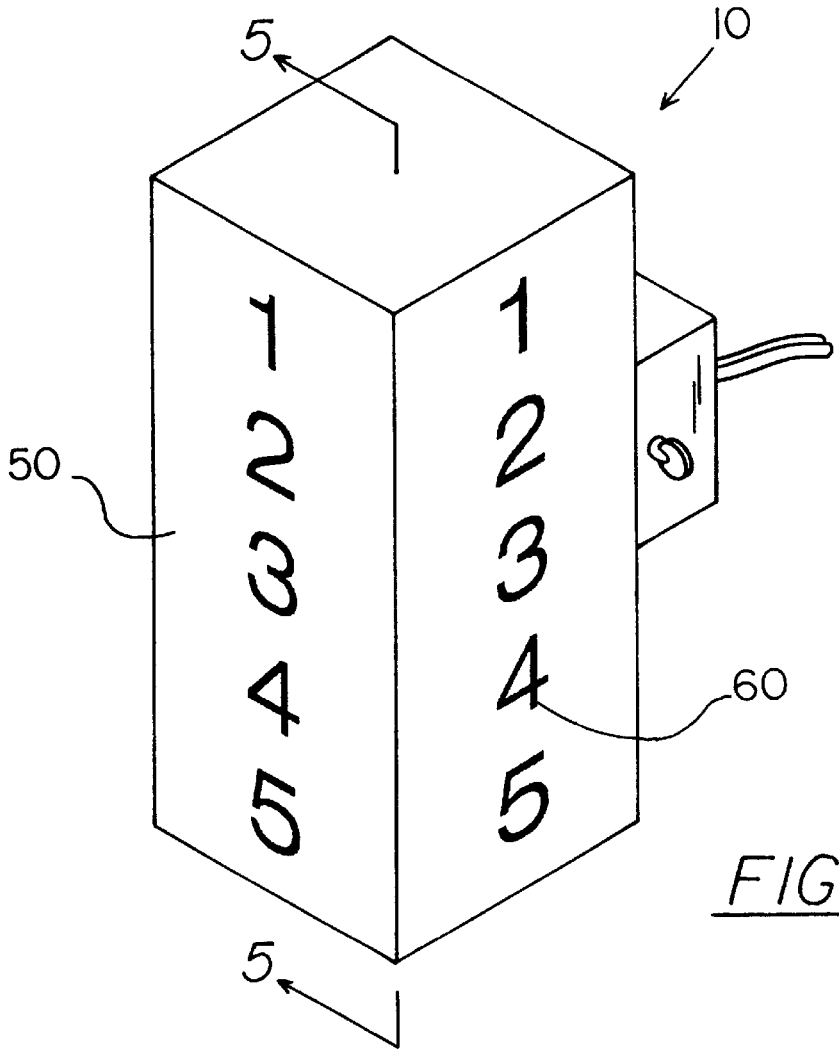
FIG. 1 is a schematic perspective view of a new illuminated address sign according to the present invention.
Figure 2:
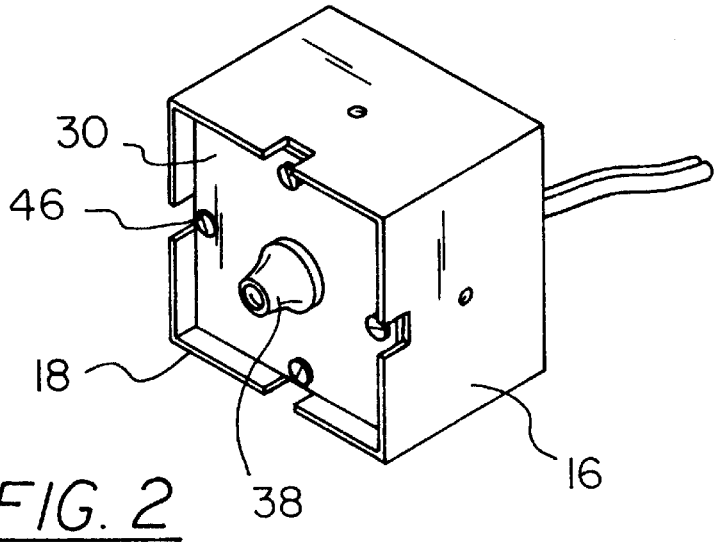
FIG. 2 is a schematic perspective view of the base and plate of the present invention.
Figure 3:
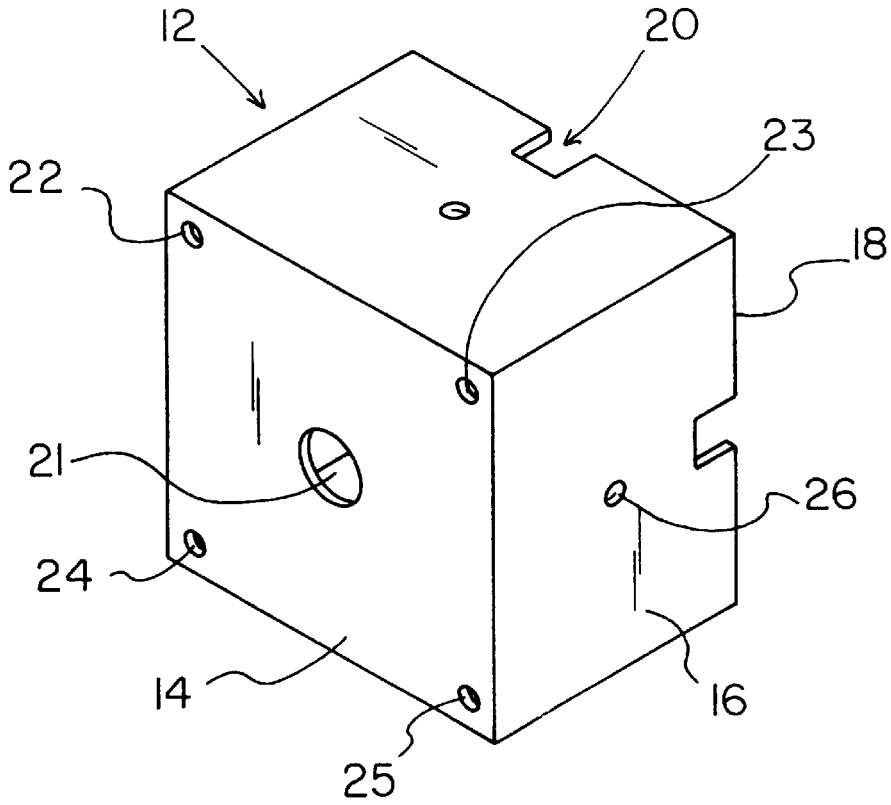
FIG. 3 is a schematic perspective view of the base of the present invention.
Figure 4:
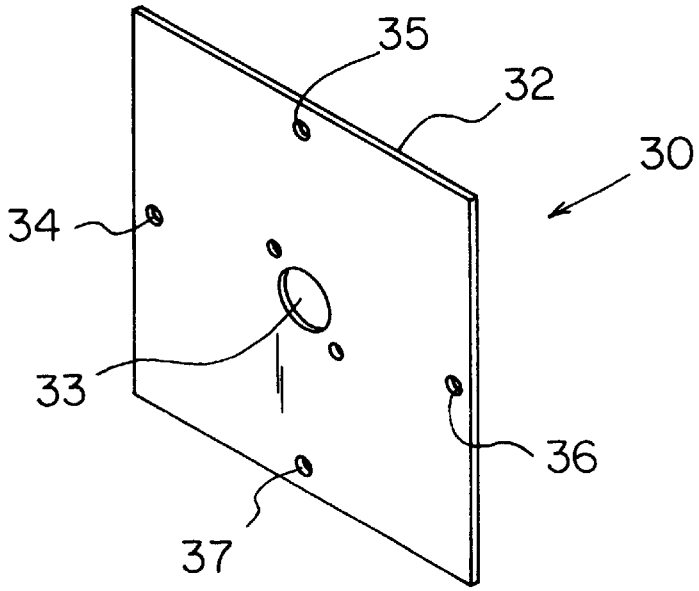
FIG. 4 is a schematic perspective view of the plate of the present invention.

With reference now to the drawings, and in particular to FIGS. 1 through 6 thereof, a new illuminated address sign embodying the principles and concepts of the present invention and generally designated by the reference numeral 10 will be described.

As best illustrated in FIGS. 1 through 6, the illuminated address sign 10 generally comprises an apparatus for holding a light bulb 11 and signage on a structure.

The apparatus has base 12 for mounting on a wall of the structure. The base 12 has base wall 14 and two pair of opposing side walls 16. An edge portion of the side walls 16 defines a peripheral edge 18. The base has an open side 20. The base wall 14 has a generally rectangular shape.

A plurality of bores 21–25 are in the base wall. The base wall has five bores therein. A first 21 of the bores is in a medial portion of the base wall 14. A second 22 through fifth 25 bores is each located generally adjacent to a corner of the base wall.

A bore 26 is in each of the side walls 16. The bores 26 in the side walls are generally located in a medial portion of the side walls 16.

A plurality of tabs 28 are formed from portions of the peripheral edge 18. Each of the side walls 18 has a tab thereon. Each of the tabs 28 is formed by a portion of the peripheral edge 18 being bent toward an interior of the base 12. Each of the tabs 28 has a bore therein. The portions of the peripheral edge 18 are in a central portion of each of the side walls 16. Each of the tabs 28 is generally rectangular.

A plate 30 for holding the light bulb, when removable from the base, has four edges 32. The plate has a plurality of bores 33–37 therein. A first of the bores 33 is located in a medial portion of the plate 30. A second 34 through fifth 37 of the bores is positioned such that the bores are generally coaxial with the bores in the tabs 28 when the plate 30 is placed in the base 12.

A light socket 38 for holding the light bulb 11 is mounted in the first bore 33 of the plate 30.

Figure 5:
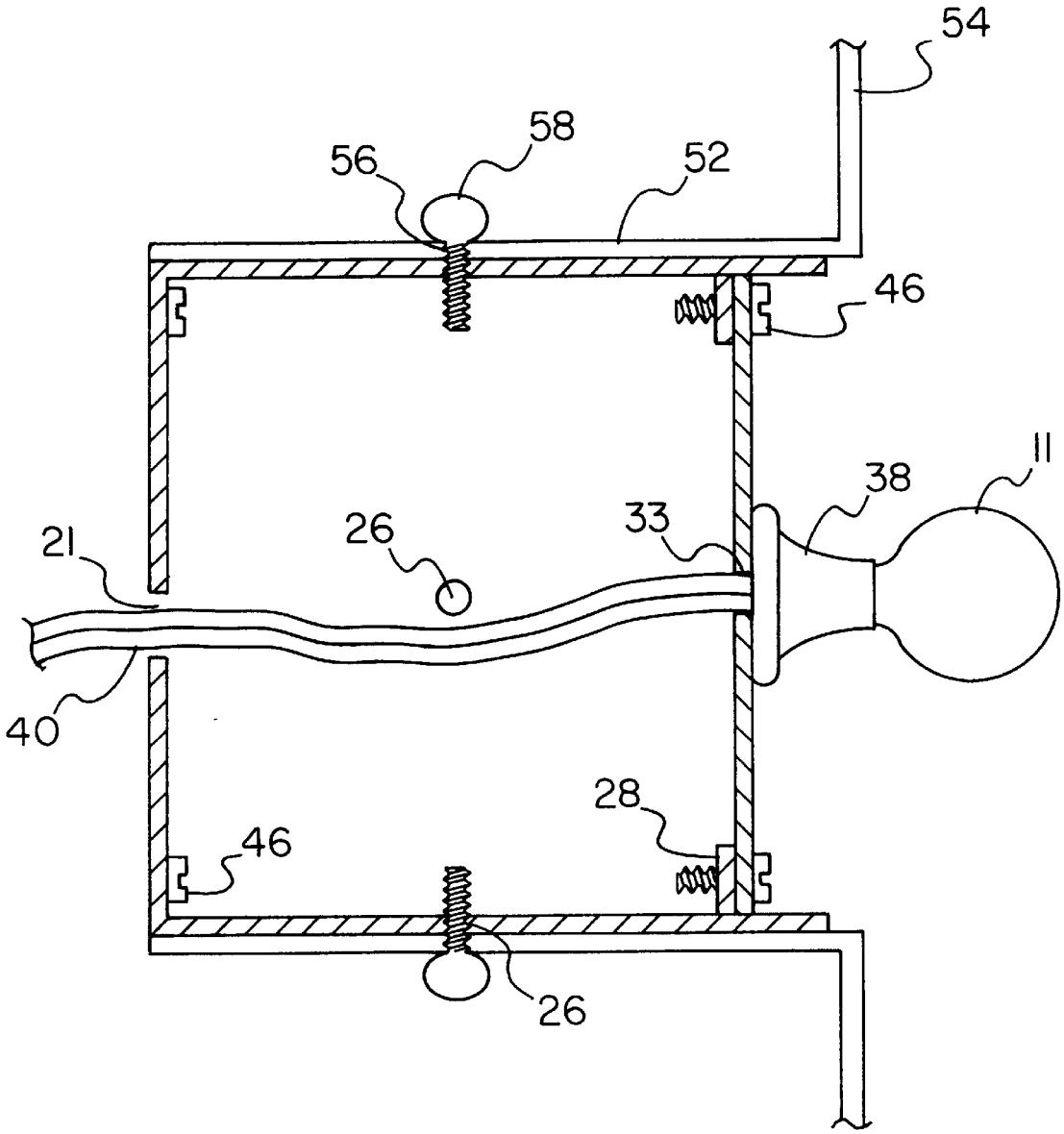
FIG. 5 is a schematic cross-sectional view taken along line 5—5 of the present invention.
Figure 6:
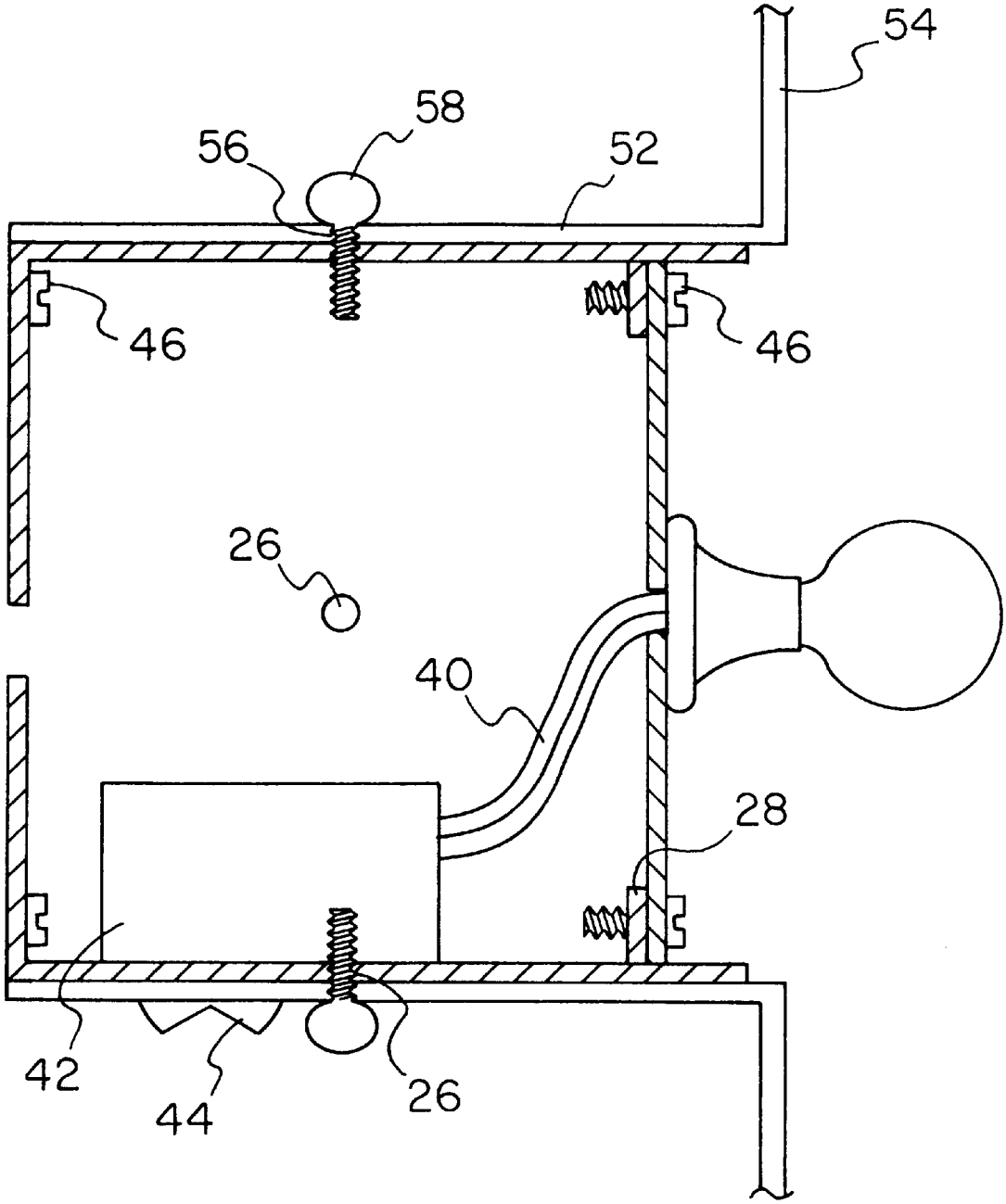
FIG. 6 is a schematic cross-sectional view of the second embodiment of the present invention.

A wire 40 connects the light socket 38 to a power source. In the first embodiment, as depicted in FIG. 5, the power source is the circuitry from the dwelling. FIG. 6 depicts a battery 42 as a power source. In the first embodiment, the wire 40 enters the base 12 through the first bore 21 in the base wall 14 and is operationally coupled to the light socket 38.

A switch 44 actuates the light bulb. The switch is electrically coupled to the wire 40. In the second embodiment, the switch 44 is preferably placed on the base adjacent to the battery 42.

A plurality of fasteners 46 holds the plate 30 to the base 12 and the base 12 to the structure. Each of the fasteners 46 is placed through a second 34 through a fifth 37 bore in the plate 30 and its associated bore in the tabs 28. Each of the fasteners 46 is placed through a second 21 through a fifth 25 bore in the base wall 14. The fasteners 46 are preferably screws.

A covering 50 for placing over the base has a first portion 52 and a second portion 54. The first portion 52 has a shape adapted to fit over the base 12 and can be made to snap onto the base 12. The second portion 54 forms a hollow enclosure. The covering 50 is formed from translucent material.

Ideally, the translucent material is plastic, glass, fiberglass, mica or plexiglass. Preferably, the second portion 54 has a generally rectangular shape.

Ideally, a plurality of bores 56 is in the covering 50. Each of the bores 56 is in the first portion 52 of the covering 50. The bores 56 in the first portion 52 of the covering 50 are positioned such that each of the bores 56 is coaxial with one of the bores 26 in the side walls 16 of the base 12 when the covering 50 is placed over the base 12. Another bore is in the covering 50 in the second embodiment in order to facilitate usage of the switch 44.

A plurality of securing means 58 secures the covering 50 to the base 12. The securing means 58 extends through the bores 56 in the first portion 52 of the covering 50 and through the bores 26 in the side walls 16 of the base 12. Ideally, each of the securing means 58 is a hand screw.

In use, the base 12 is fastened to the wall of a structure. The base 12 can be horizontal or vertical, and directed upward or downward. The plate 30, if removable, is fastened to the base 12. A light bulb 11 is placed in the socket 38. The covering 50 is then placed over the base 14 and secured to the base. Number indicia 60 are then placed on the covering 50. The number indicia 60 can be oriented in a manner suited to the way the covering 50 is mounted on the base. If the covering 50 were horizontal, the number indicia 60 would be placed horizontally. If the covering 50 were vertical, the number indicia 60 would be placed vertically on the covering.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated address sign apparatus for holding a light bulb and signage on a structure, said apparatus comprising:

a base for mounting on a wall of the structure, said base having a base wall, said base having a plate defining a top wall, said base having two pair of opposing side walls;

a plurality of bores in said base wall;

a plurality of bores in said top plate for holding the light socket;

a light socket for holding the light bulb, said light socket being mounted in one of said bores of said plate;

a wire for connecting said light socket to a power source, said wire being operationally coupled to said light socket;

a switch for actuating said light bulb;

a plurality of fasteners for holding said base to the structure, each of said fasteners being placed through one of said bores in said base wall;

a covering removably mounted over said base to enclose said light socket therein, said covering having a first portion and a second portion, said first portion having a shape adapted to fit over said base, said second portion forming an enclosure, said enclosure being hollow, said covering being formed from translucent material;

wherein said switch is mounted on said base, said switch being located on one of said side walls of said base, a portion of said switch extending through the first portion of said covering and remaining with said base when said cover is removed from said base.

2. The illuminated address sign apparatus for holding a light bulb and signage on a structure as in claim 1, said apparatus further comprises:

an edge portion of said side walls defining a peripheral edge, said base having an open side such that said plate is removably attached to said base, said base wall having a generally rectangular shape;

a plurality of tabs, said tabs being formed from portions of said peripheral edge, each of said side walls having a tab thereon, each of said tabs being formed by a portion of said peripheral edge being bent toward an interior of said base, each of said tabs having a bore therein;

said plate having four edges, said plate having a plurality of bores therein, a first of said bores being located in a medial portion of said plate, a second through fifth of said bores being positioned such that said bores are generally coaxial with said bores in said tabs when said plate is placed in said base, wherein said light socket is mounted in said first bore of said plate, said plate being spaced rearwardly from said peripheral edge of said side walls toward said base wall; and a plurality of fasteners for holding said plate, each of said fasteners being placed through a second through a fifth bore in said plate and its associated bore in said tabs.

3. The illuminated address sign apparatus for holding a light bulb and signage on a structure as in claim 1, further comprising:

a bore in each of said side walls;

a plurality of bores in said covering, each of said bores being in said first portion of said covering, said bores in said first portion of said covering being positioned such that each of said bores is coaxial with one of said bores in said side walls of said base when said covering is placed over said base; and a plurality of securing means for securing said covering to said base, said securing means extending through said bores in said first portion of said covering and through said bores in said side walls of said base.

4. The illuminated address sign apparatus for holding a light bulb and signage on a structure as in claim 1, wherein said translucent material of said covering is selected from the group consisting of plastic, glass, fiberglass, mica and plexiglass, said enclosure having a generally rectangular shape.

5. The illuminated address sign apparatus for holding a light bulb and signage on a structure as in claim 1, wherein said power source comprises a battery housed in said base.

6. An illuminated address sign apparatus for holding a light bulb and signage on a structure, said apparatus comprising:

a base for mounting on a wall of the structure, said base having base wall, said base having two pair of opposing side walls, an edge portion of said side walls defining a peripheral edge, said base having an open side, said base wall having a generally rectangular shape;

a plurality of bores in said base wall, said base wall having five bores therein, a first of said bores being in a medial portion of said base wall, a second through fifth bores each being located generally adjacent to a corner of said base wall;

a bore in each of said side walls, each of said bores in said side walls being generally located in a medial portion of said side walls;

a plurality of tabs, said tabs being formed from portions of said peripheral edge, each of said side walls having a tab thereon, each of said tabs being formed by a portion of said peripheral edge being bent toward an interior of said base, each of said tabs having a bore therein, said portions of said peripheral edge being in a central portion of each of said side walls, each of said tabs being generally rectangular;

a plate for holding the light socket, said plate having four edges, said plate having a plurality of bores therein, a first of said bores being located in a medial portion of said plate, a second through fifth of said bores being positioned such that said bores are generally coaxial with said bores in said tabs when said plate is placed in said base;

a light socket for holding the light bulb, said light socket being mounted in said first bore of said plate;

a wire for connecting said light socket to a power source, said wire entering said base through said first bore in said base wall, said wire being operationally coupled to said light socket;

a switch for actuating the light bulb, said switch being electrically coupled to said wire;

a plurality of fasteners for holding said plate to said base and said base to the structure, each of said fasteners being placed through a second through a fifth bore in said plate and its associated bore in said tabs, each of said fasteners being placed through a second through a fifth bore in said base wall, said fasteners being screws;

a covering for placing over said base, said covering having a first portion and a second portion, said first portion having a shape adapted to fit over said base, said second portion forming an enclosure, said enclosure being hollow, said covering being formed from translucent material, said translucent material being selected from the group consisting of plastic, glass, fiberglass, mica and plexiglass, said second portion having a generally rectangular shape;

a plurality of bores in said covering, each of said bores being in said first portion of said covering, said bores in said first portion of said covering being positioned such that each of said bores is coaxial with one of said bores in said side walls of said base when said covering is placed over said base; and a plurality of securing means for securing said covering to said base, said securing means extending through said bores in said first portion of said covering and through said bores in said side walls of said base, each of said securing means being a hand screw.

7. The illuminated address sign apparatus for holding a light bulb and signage on a structure as in claim 1, wherein the second portion of said covering is elongated and extends in opposite directions from said first portion of said covering.

8. The illuminated address sign apparatus for holding a light bulb and signage on a structure as in claim 1, wherein the second portion of said covering is elongate and has a substantially square transverse cross-sectional shape.

9. The illuminated address sign apparatus for holding a light bulb and signage on a structure as in claim 1, wherein the second portion of said covering is elongated and extends in opposite directions from said first portion of said covering; and wherein the second portion of said covering is elongate and has a substantially square transverse cross-sectional shape.

* * * * *